United States Patent [19]

Pool

[11] 4,134,608

[45] Jan. 16, 1979

[54] COMBINATION DOOR STOP AND CATCH

[76] Inventor: Joseph R. Pool, 1809 Merkley Ave., W. Sacramento, Calif. 95691

[21] Appl. No.: 879,238

[22] Filed: Feb. 21, 1978

[51] Int. Cl.[2] ..... E05C 19/06

[52] U.S. Cl. ..... 292/76; 16/82; 292/DIG. 19; 16/DIG. 17

[58] Field of Search ..... 16/82, 83, 85, DIG. 17, 16/DIG. 21; 109/63.5; 292/340, 341, 341.12, 76, DIG. 19, 87, DIG. 15, DIG. 38; 49/379

[56] References Cited

U.S. PATENT DOCUMENTS

| | | | |
|---|---|---|---|
| 355,852 | 1/1887 | Armstrong | 16/83 |
| 813,343 | 2/1906 | Bartlett | 292/DIG. 19 |
| 1,688,221 | 10/1928 | Abbey | 292/DIG. 19 |
| 2,541,890 | 2/1951 | Schaperkotter et al. | 292/76 X |
| 2,784,443 | 3/1957 | Von Berg | 16/85 |

*Primary Examiner*—Werner H. Schroeder
*Assistant Examiner*—Moshe I. Cohen

[57] ABSTRACT

The invention relates to a combination door stop and catch in the form of a molded unit adapted for mounting to the wall surface behind a door in its open position, and adapted, not only to function as a stop for the door before the knob of the door can engage such wall, but to perform the additional function of a catch, to preclude self closing of the door. The catch offers limited though essential restraint for this purpose, but enables automatic release of the door in response to application of force to the door in the direction of closing.

2 Claims, 3 Drawing Figures

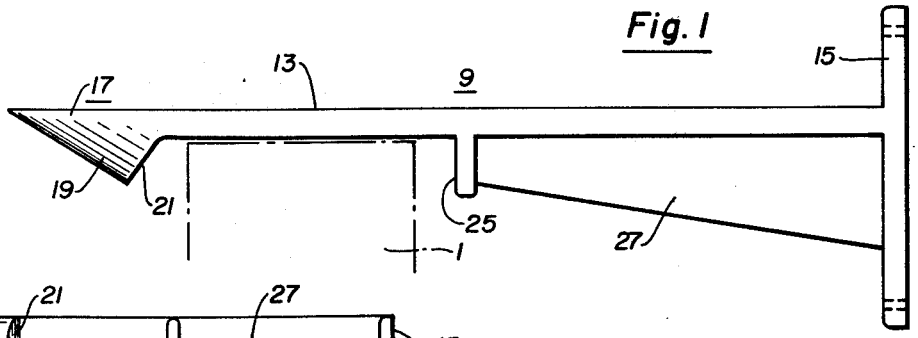
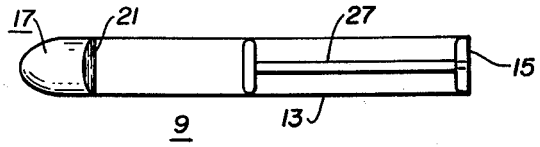
Fig. 2
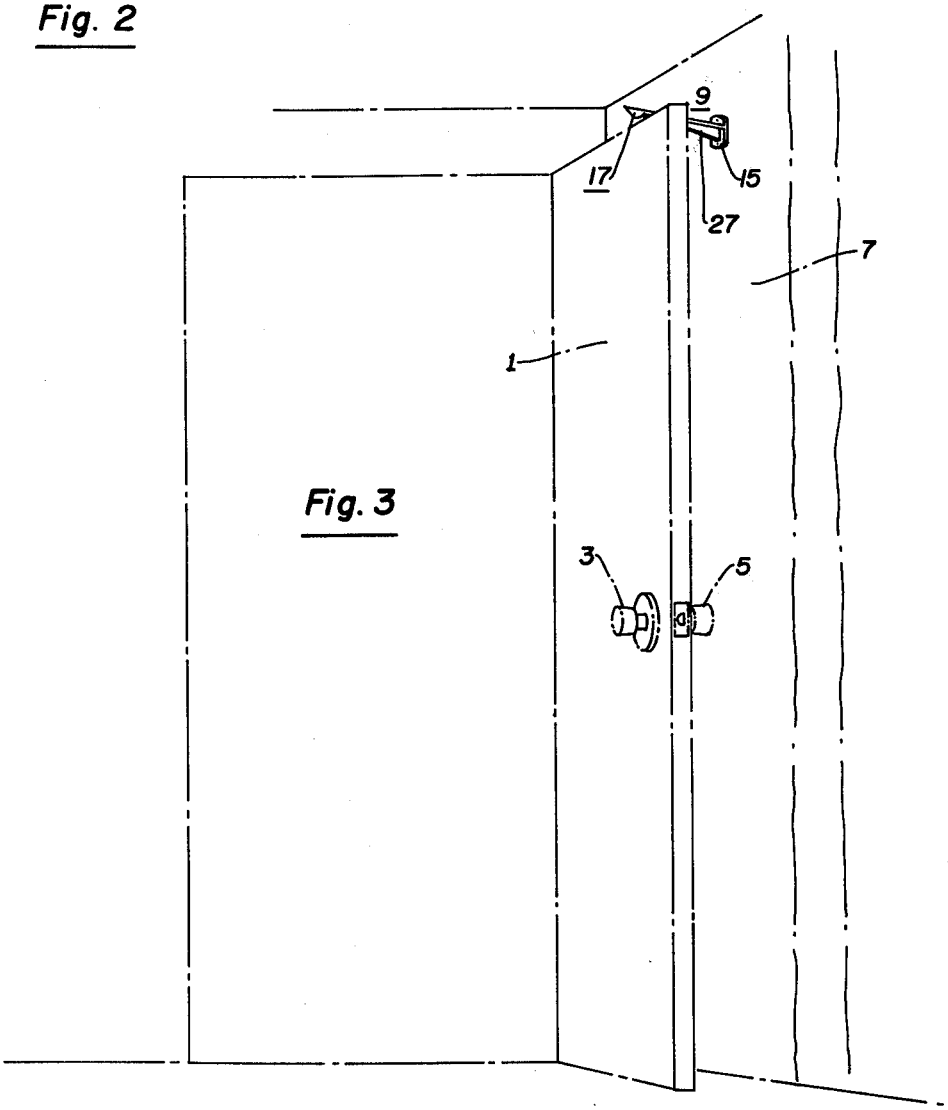
Fig. 3

COMBINATION DOOR STOP AND CATCH

My invention relates to hinge mounted doors and more particularly to a combined door stop and catch for use with such doors.

Without the reliance on any means for controlling the open position of hinge mounted doors, the door knobs with which such doors are provided, can engage the wall behind such door in its open position, with impact sufficient to create a recess or dent in the wall at the location of impact, or even cause a fracture of the plaster or other wall material at the location of the impact.

As a measure of protection against such impact of the wall by the door knob, it is customary to install a door stop in the baseboard at the base of the wall, such door stop extending from the baseboard sufficiently to stop opening movement of the door before the door knob can engage the wall behind the door and cause damage.

Such door stops do not preclude self closing of the door in response to air currents or improper installation of the door, and interfere with proper use of the vacuum cleaning equipment as when vacuum cleaning rugs, and particularly, wall to wall carpeting.

Among the objects of my invention are:

(1) To provide a novel and improved combination door stop and catch;

(2) To provide a novel and improved combination door stop and catch of simple construction;

(3) To provide a novel and improved combination door stop and catch which can be molded in a single unit;

(4) To provide a novel and improved combinaton door stop and catch which will automatically release itself in response to a force applied to the door in the direction of closing the same;

(5) To provide a novel and improved combination door stop and catch which may be installed so as not to interfere with normal vacuuming of rugs in the vicinity.

Additional objects of my invention will brought out in the following description of a preferred embodiment of the same, taken in conjunction with accompanying drawings wherein:

FIG. 1 is a side view in elevation of the combination door stop and catch of the present invention, in its preferred form;

FIG. 2 is an underside plan view of the device of FIG. 1;

FIG. 3 is a view depicting the manner of installation and use of the combination door stop and catch of FIGS. 1 and 2.

Referring to the drawings for a description of the invention in its preferred form, the invention is for use with a door 1 provided with conventional door knobs 3, 5 and opening inwardly of a room toward a wall 7 of the room.

The combination door stop and catch 9 comprises a bracket arm 13 having means 15 at one end for use in affixing the arm to the surface of the wall 7 with the arm extending substantially normal to such wall.

This arm, at its opposite end, is provided with a downwardly extending tongue 17 having a substantially arcuate downwardly tapered frontal surface 19 and a steeper rearward surface 21 of a planar character.

At an intermediate location on the arm and depending therefrom in spaced relationship to the mounting means 15 and the tongue 17, is a stop 25, the spacing between the stop and the tongue being sufficient to receive the edge of a conventional door with which the combined door catch and stop is to be used. The spacing of the catch from the mounting means for the arm is slightly in excess of the length of the door knob extending from the rear side of the door in the open position of the door.

Extending from the mounting means to the middle of the stop and formed integrally therewith, is a reinforcing rib 27 which serves to rigidify the rearward portion of the arm and brace the stop to thereby enable it to perform its function more effectively.

The device is preferably mounted on the wall behind the door in its open position, and substantially in line with the upper edge of the door whereby, when the door is opened, the door will engage the arcuate downwardly tapering frontal surface of the tongue causing the forward section of the arm 13 to flex upwardly and permit the door to slip in behind the tongue 17 and engage the stop. In the meantime, the flexed portion of the arm will restore itself to normalcy and catch the door in its open position and so retain it.

The distance of the stop from the mounting means being greater than the length of the door knob, the door will be stopped before the door knob can engage the proximate wall behind the door.

The ability of the device to retain the door in its open position against closing in response to such things as drafts or improper installation of the door, is attributable to the steep sloping of the rear planar surface of the tongue, and while sufficient for such purpose, the sloping surface enables the door to respond to a manual force applied to the door in the direction of closing, since the door in response to such applied closing force, will engage the rear surface of the tongue, causing the forward end of the arm to again flex upwardly, enabling the door to slide out from under the tongue and thus be released from the catch.

From the foregoing description of my invention in its preferred form, it will be apparent that the same is subject to alteration and modification without departing from the underlying principles involved, and I, accordingly, do not desire to be limited in my protection to the specific details illustrated and described except as may be necessitated by the appended claims.

I claim:

1. A combined door stop and catch comprising a flexible bracket arm having means at one end for use in affixing said arm to a wall with said arm extending substantially normal to such wall, said arm, at its opposite end having a downwardly extending tongue, said tongue having a substantially arcuate downwardly tapering frontal surface and a steeper rearward camming surface, said arm at an intermediate location thereon, having a depending stop spaced from said tongue by a distance sufficient to receive the edge of a door with which the combined door catch and stop is to be used and spaced from said mounting means a distance slightly in excess of the length of a door knob on such door, whereby when affixed to a wall in the path of an opening door and at a location in line with an edge of such door, said door, in engaging the downwardly tapered surface of said tongue will flex said arm sufficiently to enter the space behind said tongue and engage said stop to preclude contact of such door knob with such wall, said door being precluded from self closing by said tongue functioning as a catch, said arm, mounting means, tongue, and stop being molded as a unitary structure.

2. A combined door stop and catch in accordance with claim 1, characterized by a rib on the underside of said arm between said mounting means and said stop and in bracing relationship to said stop.

* * * * *